US006413174B1

(12) United States Patent
Roberts

(10) Patent No.: US 6,413,174 B1
(45) Date of Patent: Jul. 2, 2002

(54) GOLF DIVOT REPAIR TOOL

(76) Inventor: David M. Roberts, 20512 S. 4215 Rd., Claremore, OK (US) 74017

( * ) Notice: Subject to any disclaimer, the term of this patent is extended or adjusted under 35 U.S.C. 154(b) by 0 days.

(21) Appl. No.: 09/820,260

(22) Filed: Mar. 28, 2001

(51) Int. Cl.[7] ..... A63B 57/00
(52) U.S. Cl. ..... 473/408
(58) Field of Search ..... 473/408, 286; D21/793; 30/162, 163

(56) References Cited

U.S. PATENT DOCUMENTS 2,904,884 A * 9/1959 Baum ..... 30/162
3,360,807 A * 1/1968 Mauck ..... 473/408
3,456,737 A * 7/1969 Rhyme ..... 473/408
3,539,017 A * 11/1970 Johnson ..... 473/408
4,955,609 A * 9/1990 Kassen ..... 473/286
5,143,371 A 9/1992 Strahan
5,388,824 A * 2/1995 Reimers ..... 473/408
5,449,169 A 9/1995 Hardin et al.
5,511,785 A * 4/1996 Rusin, Jr. ..... 473/286
5,562,553 A 10/1996 Digerness et al.
5,759,111 A 6/1998 Clark
6,030,298 A 2/2000 Tate

* cited by examiner

*Primary Examiner*—Steven Wong
(74) *Attorney, Agent, or Firm*—Molly D. McKay

(57) ABSTRACT

A device that is a retractable golf divot repair tool, a tool for attaching and removing soft spikes from the soles of golf shoes, and a holder for a ball marker. The present invention is provided with a case into which the pointed ends of the tool retract, and the case has an indentation provided in it to removably receive a ball marker that attaches magnetically to the indentation.

4 Claims, 3 Drawing Sheets

GOLF DIVOT REPAIR TOOL

BACKGROUND OF THE INVENTION

1. Field of the Invention

The present invention relates to a device that serves as a multi-functional tool. It is a retractable golf divot repair tool, it is a tool for attaching and removing soft spikes from the soles of golf shoes, and it is a holder for markers used in marking the position of golf balls on the golf course.

2. Description of the Related Art

When a golfer heads for the golf course, he needs several items. First, he needs a golf divot repair tool so that he can repair the sod when he disturbs it during play. Divot repair tools are provided with pointed ends to stick down into the sod in order to lift the sod. Because these pointed ends can stick the golfer, it is desirable that the tool be retractable into a cover to prevent the golfer from being poked by the pointed ends when he is carrying the tool in his pocket.

Second, since most of today's golfers wear golf shoes with replaceable soft spikes, a golfer needs to carry a tool to remove and replace soft spikes from the soles of his shoes.

Finally, a golfer needs a ball marker when he goes to play golf.

The present invention addresses all of these needs by providing a golf divot repair tool that is also a tool for engaging soft spikes. The present invention is provided with a case into which the pointed ends of the tool retract, and the case has an indentation provided in it to removably receive a ball marker that attaches magnetically to the indentation.

SUMMARY OF THE INVENTION

The present invention is a tool with a retractable portion that can be placed into three separate positions relative to the outside case of the tool: a first extended position where two pointed arms provided on the retractable portion protrude complete out of the case for use in repairing divots, as second partially extended position where the two pointed arms protrude only part way out of the case for use in attaching soft spikes to the sole of a golfer's shoes, and a third fully retracted position where the two pointed arms are fully retracted within the case for when the tool is not in use.

The retractable portion is movably sandwiched between an upper plate and a lower plate. A decorative top outside cover is attached to the upper plate and a decorative bottom outside cover is attached to the lower plate.

The upper plate and the top outside cover are each provided with a slot that extends along a longitudinal axis of the tool and communicates completely through its respective plate or cover. Each slot is sufficiently wide so that a neck portion of a latching mechanism extends through the slot and travels along the length of the slot between opposite ends of the slot.

An upper end of the neck portion is provided with male threads that removably engage female threads provided in a shank portion of a button knob. The button knob extends outward beyond the case. The neck portion is secured on its opposite end to a cylindrical shoulder so that the cylindrical shoulder is located between the neck portion and a lower cylindrical end of the latching mechanism. The latching mechanism is hollow and has an opening at the lower cylindrical end that communicates with the hollow interior compartment. The interior compartment consists of a larger diameter portion located adjacent to the opening and a smaller diameter portion located inward of the larger diameter portion that forms the terminus for the interior compartment. A compartment shoulder is formed in the hollow interior compartment at the intersection of the two portions.

A detent inserts in the hollow interior compartment along with a spring so that the spring enters the smaller diameter portion of the compartment and biases the detent outward. The detent has a rounded end that extends out of the opening and an opposite smaller end that inserts into the center of the spring so that a detent shoulder is formed at the intersection of the rounded end and the smaller end. When the detent is forced upward into the hollow interior compartment, the detent shoulder engages the compartment shoulder, thus limiting the upward movement of the detent within the compartment.

The lower cylindrical end of the latching mechanism inserts through a cylindrical opening that communicates through an end of the retractable portion located opposite the two pointed arms. When the latching mechanism is thus positioned, the shoulder lies above the plane of the retractable portion and the lower cylindrical end extends through the cylindrical opening and terminates below the plane of the retractable portion.

The upper plate is provided with a first upper channel of a sufficient depth to movably accommodate approximately half the thickness of the retractable portion. This first upper channel is closed at a first end and is open at a second end so that the retractable portion can be moved out of the case to its fully extended position at the second end of the first upper channel. Above this first upper channel, the upper plate is provided with a second upper channel for movably accommodating the shoulder of the latching mechanism.

Likewise, the lower plate is provided with a first lower channel of a sufficient depth to movably accommodate approximately half the thickness of the retractable portion. This first lower channel is closed at a first end and is open at a second end so that the retractable portion can be moved out of the case to its fully extended position at the second end of the first lower channel. Below this first lower channel, the lower plate is provided with a second lower channel for movably accommodating the lower cylindrical end of the latching mechanism. Below the second lower channel, the lower plate is provided with three concave indentations for removably receiving the rounded end of the detent as a means of latching the retractable portion in its fully extended position, its partially extended position, and its fully retracted position.

Together the first upper channel and the first lower channel define a channel compartment inside the case within which the retractable portion moves between its fully extended position and its fully retracted position. The upper and lower plates are secured together by means of screws that insert through screw openings provided in the upper plate and engage threaded screw openings provided in the lower plate.

The decorative top outside cover attaches to an outwardly facing surface of the upper plate by glue or other suitable fastening means. Likewise, and the decorative bottom outside cover attaches to an outwardly facing surface of the lower plate by glue or other suitable fastening means.

The decorative bottom outside cover is provided with an indented compartment into which a magnet is permanently affixed. The indented compartment is sufficiently large to accommodate a metal ball marker that is held in the indented compartment by the magnet. The magnet does not cover the entire surface of the indented compartment. Thus, to remove the ball marker from the indented compartment, the user presses on the ball mark at a location where the magnet is not present. This pressure causes the ball marker to tilt out of the indented compartment and the ball marker can be easily grasped and removed from the tool.

DETAILED DESCRIPTION OF THE PREFERRED EMBODIMENT

The Invention

Figure 1:
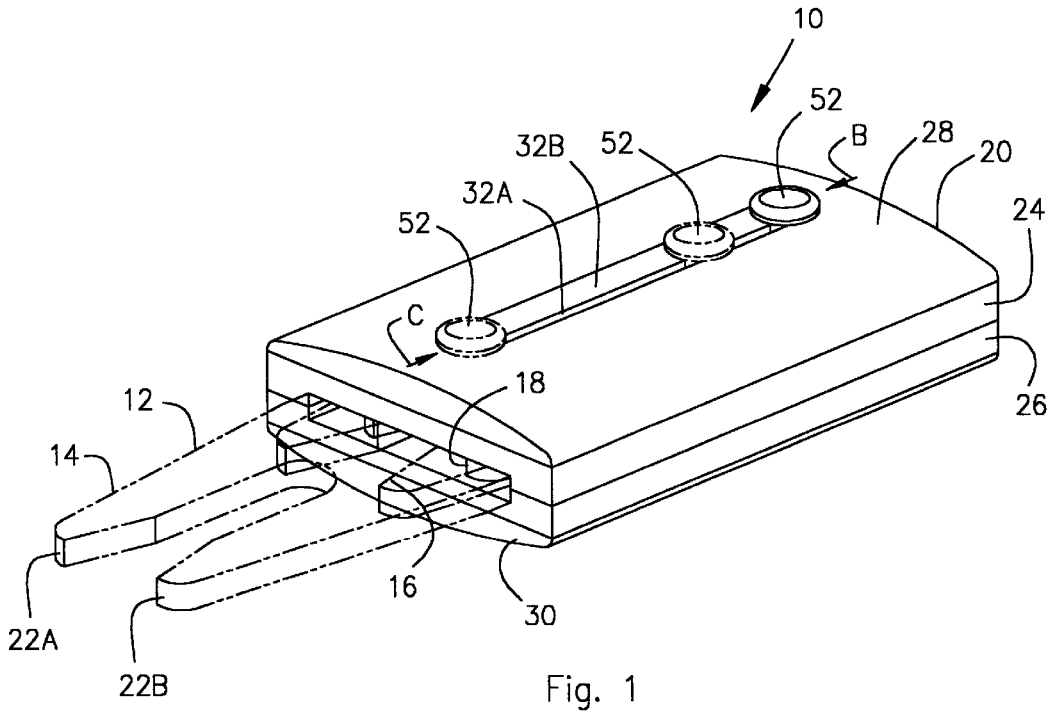
FIG. 1 is a perspective view of a golf divot repair tool constructed in accordance with a preferred embodiment of the present invention.
Figure 2:
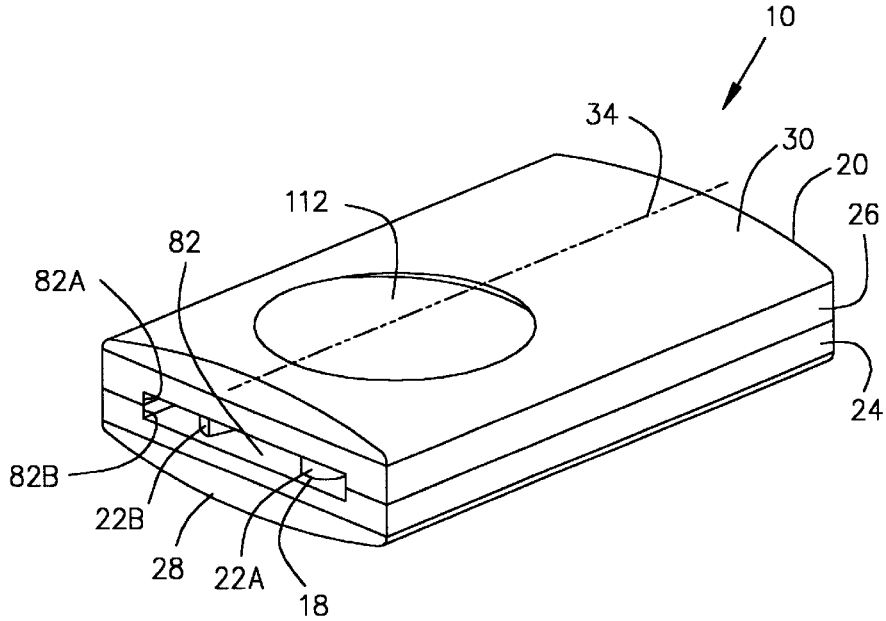
FIG. 2 is a perspective view of the reverse side of the tool of FIG. 1.

Referring now to FIGS. 1 and 2, there is illustrated a golf divot repair tool 10 constructed in accordance with a preferred embodiment of the present invention. The tool 10 is provided with a retractable portion 12 that can be placed into three separate positions 14, 16 and 18 relative to the outside case 20 of the tool 10.

As illustrated in outline in FIG. 1, the first position 14 is a fully extended position where two pointed arms 22A and 22B provided on the retractable portion 12 are protrude complete out of the case 20. The tool 10 is placed in this first position 14 when the pointed arms 22A and 22B are employed to repair divots.

Also as illustrated in outline in FIG. 1, the second position 16 is a partially extended position where the two pointed arms 22A and 22B protrude only part way out of the case 20. The tool is placed in this second position 16 when the pointed arms 22A and 22B are employed to engage indentations provided in soft spikes attaching to the sole of a golfer's shoes.

Figure 3:
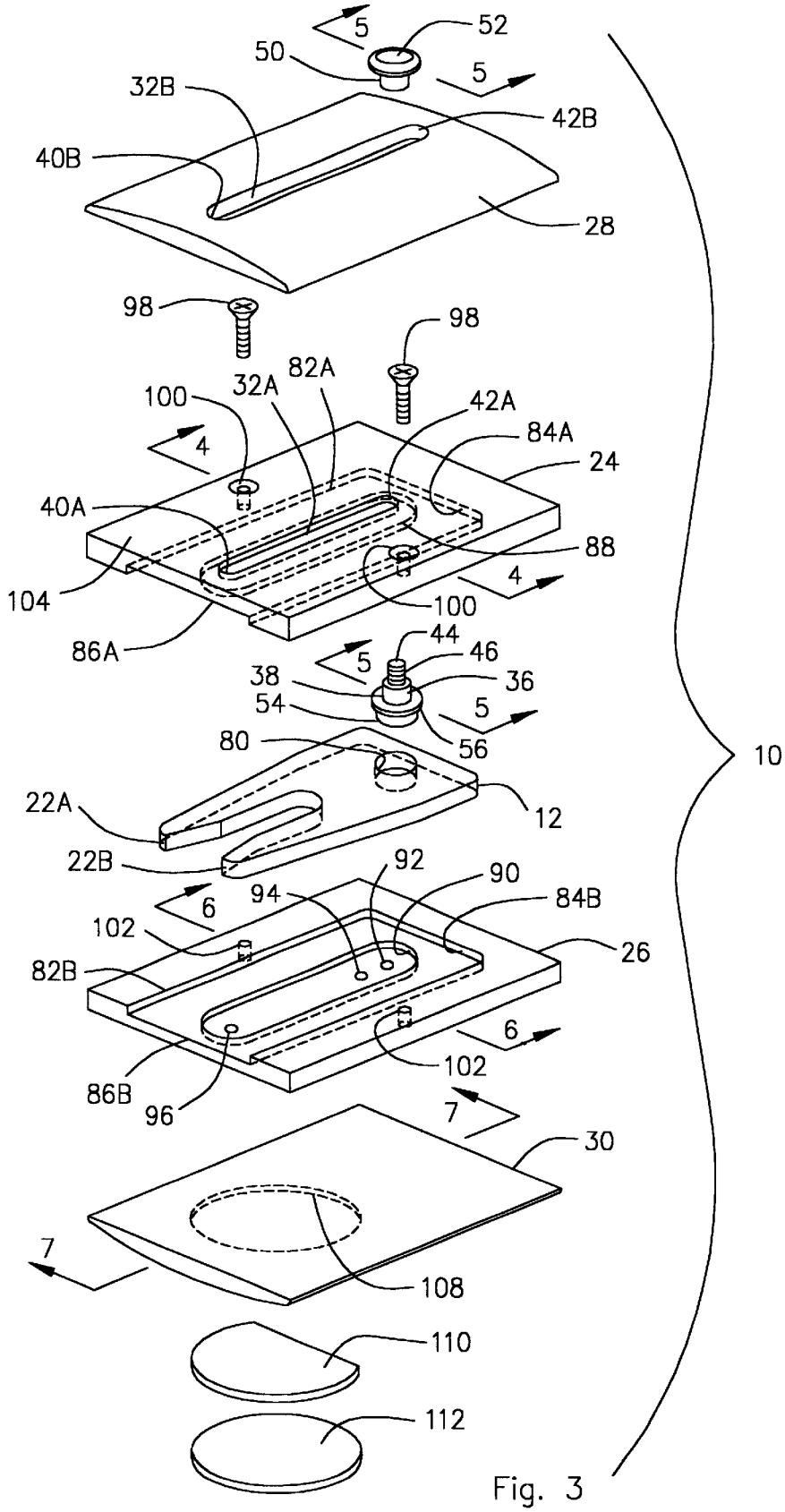
FIG. 3 is an exploded view of the tool of FIG. 1 showing the arrangement of the various parts that comprise the tool.

Finally, as illustrated in FIGS. 2 and 3, the third position 18 is a fully retracted position where the two pointed arms 22A and 22B do not protrude out of the case 20 but are fully retracted therein. The tool 10 is placed in this third position 16 when the tool 10 is not in use, such as when it is being carried in a golfer's pocket. In this third position 18, the two pointed arms 22A and 22B are fully retracted within the case 20 and do not present a poking hazard that could injure the golfer.

Referring now to FIG. 3, the details of construction for the tool 10 are illustrated. The retractable portion 12 is movably sandwiched between two plates, an upper plate 24 and a lower plate 26. A decorative top outside cover 28 is attached to the upper plate 24 and a decorative bottom outside cover 30 is attached to the lower plate 26. The decorative top outside cover 28 and bottom outside cover 30 are preferably constructed of an attractive material, such as for example wood.

The upper plate 24 and the top outside cover 28 are each provided with a slot, 32A and 32B respectively. Each of the slots 32A and 32B extends along a longitudinal axis 34 of the tool 10 and communicates completely through its respective plate 24 or cover 28. The slot 32A is sufficiently wide so that a neck portion 36 of a latching mechanism 38 extends through the slot 32A and travels along the length of the slot 32A between its opposite ends 40A and 42A. Likewise, slot 32B is sufficiently wide so that the neck portion 36 of the latching mechanism 38 also extends through the slot 32B and travels along the length of the slot 32B between its opposite ends 40B and 42B.

Figure 5:
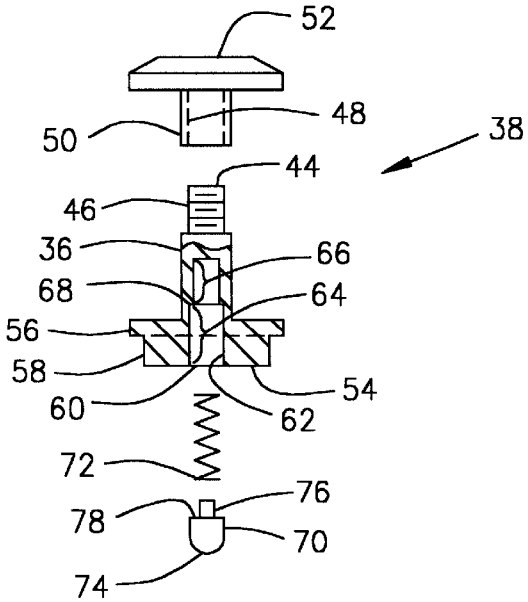
FIG. 5 is a cross sectional view of the latching mechanism taken along lines 5—5 of FIG. 3.

As shown in FIG. 5, an upper end 44 of the neck portion 36 is provided with male threads 46 that removably engage female threads 48 provided in a shank portion 50 of a button knob 52, as will be further described hereafter. The neck portion 36 is secured on its opposite end 54 to a cylindrical shoulder 56 so that the cylindrical shoulder 56 is located between the neck portion 36 and a lower cylindrical end 58 of the latching mechanism 38. The latching mechanism 38 is hollow and has an opening 60 at the lower cylindrical end 58 that communicates with the hollow interior compartment 62. The interior compartment 62 consists of a larger diameter portion 64 located adjacent to the opening 60 and a smaller diameter portion 66 located inward of the larger diameter portion 64 that forms the terminus for the interior compartment 62. A compartment shoulder 68 is formed in the hollow interior compartment 62 at the intersection of the two portions 64 and 66.

A detent 70 inserts in the hollow interior compartment 62 along with a spring 72 so that the spring 72 enters the smaller diameter portion 66 of the compartment 62 and biases the detent 70 outward. The detent 70 has a rounded end 74 that extends out of the opening 60 and an opposite smaller end 76 that inserts into the center of the spring 72 so that a detent shoulder 78 is formed at the intersection of the rounded end 74 and the smaller end 76. When the detent 70 is forced upward into the hollow interior compartment 62, the detent shoulder 78 engages the compartment shoulder 68, thus limiting the upward movement of the detent 70 within the compartment 62, as will become apparent hereafter.

The lower cylindrical end 58 of the latching mechanism 38 inserts through a cylindrical opening 80 that communicates through an end 82 of the retractable portion 12 located opposite the two pointed arms 22A and 22B. When the latching mechanism 38 is thus positioned, the shoulder 54 lies above the plane of the retractable portion and the lower cylindrical end 58 extends through the cylindrical opening 80 and terminates below the plane of the retractable portion 12.

Figure 4:
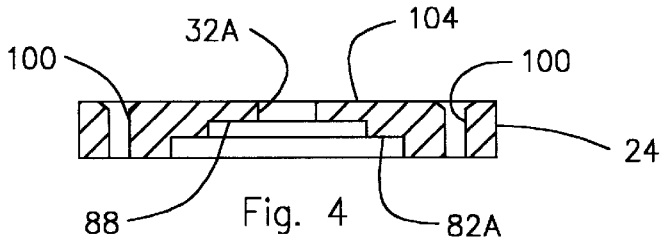
FIG. 4 is a cross sectional view of the upper plate of the tool taken along line 4—4 of FIG. 3.

As illustrated in FIG. 4, the upper plate 24 is provided with a first upper channel 82A of a sufficient depth to movably accommodate approximately half the thickness of the retractable portion 12. This first upper channel 82A is closed at a first end 84A and is open at a second end 86A so that the retractable portion 12 can be moved out of the case 20 to its fully extended position 14 at the second end 86A of the first upper channel 82A. Above this first upper channel 82A, the upper plate 24 is provided with a second upper channel 88 for movably accommodating the shoulder 56 of the latching mechanism 38.

Figure 6:
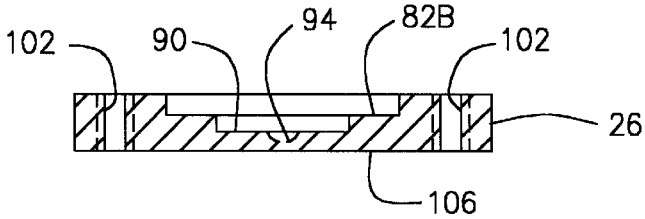
FIG. 6 is a cross sectional view of the lower plate of the tool taken along line 6—6 of FIG. 3.

Likewise, as illustrated in FIG. 6, the lower plate 26 is provided with a first lower channel 82B of a sufficient depth to movably accommodate approximately half the thickness of the retractable portion 12. This first lower channel 82B is closed at a first end 84B and is open at a second end 86B so that the retractable portion 12 can be moved out of the case 20 to its fully extended position 14 at the second end 86B of the first lower channel 82B. Below this first lower channel 82B, the lower plate 26 is provided with a second lower channel 90 for movably accommodating the lower cylindrical end 58 of the latching mechanism 38. Below the second lower channel 90, the lower plate 26 is provided with three concave indentations 92, 94, and 96 for removably receiving the rounded end 74 of the detent 70 as a means of latching the retractable portion 12, respectively, in its fully retracted position 18, its partially extended position 16, and its fully extended position 14.

Together the first upper channel 82A and the first lower channel 82B define a channel compartment 82 inside the case 20 within which the retractable portion 12 moves between its fully extended position 14 and its fully retracted position 18. The upper and lower plates 24 and 26 are secured together by means of screws 98 that insert through screw openings 100 provided in the upper plate 24 and engage threaded screw openings 102 provided in the lower plate 26.

The decorative top outside cover 28 attaches to an outwardly facing surface 104 of the upper plate 24 by glue or other suitable fastening means. Likewise, and the decorative bottom outside cover 30 attaches to an outwardly facing surface 106 of the lower plate 26 by glue or other suitable fastening means.

Figure 7:
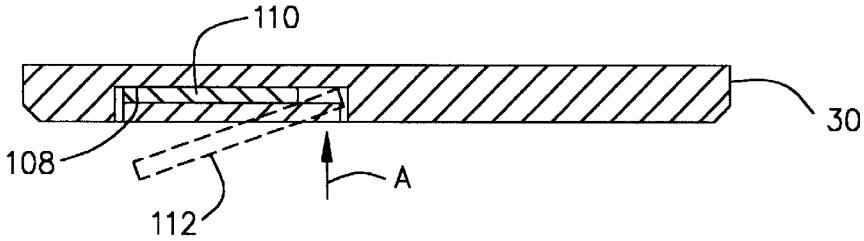
FIG. 7 is a cross sectional view of the bottom outside cover taken along line 7—7 of FIG. 3 showing the indention and magnet that hold a ball marker within the indention.

The decorative bottom outside cover 30 is provided with an indented compartment 108 into which a magnet 110 is permanently affixed. The indented compartment 108 is sufficiently large to accommodate a metal ball marker 112 that is held in the indented compartment 108 by the magnet 110. As shown in FIGS. 3 and 7, the magnet 108 does not cover the entire surface of the indented compartment 108. Thus, to remove the ball marker 112 from the indented compartment 108, the user presses on the ball mark 112 at a location here the magnet 110 is not present, as indicated by Arrow A in FIG. 7. This pressure causes the ball marker 112 to tilt out of the indented compartment 108, as shown in outline in FIG. 7, and from this position the ball marker 112 can be easily grasped and removed from the tool 10.

Use of the Invention

The tool 10 is carried in a user's pocket in its fully retracted position 18. In this position, the rounded end 74 of the detent 70 rests in the first concave indentation 92 and the force of the spring 72 pushing downward on the detent 70 holds the retractable portion 12 within the case 20 until a pushing force, as shown by Arrow B in FIG. 1, is exerted by the user on the button knob 52.

The pushing force of Arrow B causes the detent 70 to move upward within the hollow interior compartment 62 of the latching mechanism 38 so that the rounded end 74 of the detent 70 disengages the first concave indentation 92, allowing the retractable portion 12 to move to its partially extended position 16. In its partially extended position 16, the rounded end 74 of the detent 70 enters the second concave indentation 94 which holds the retractable portion 12 in this position 16 until a further pushing force Arrow B is applied to the button knob 52. The pointed arms 22A and 22B can be used as a tool for engaging a soft spike for a golf shoe when the retractable portion 12 is in its partially extended position 16.

When a further pushing force Arrow B is applied to the button knob 52, the detent 70 again moves upward within the hollow interior compartment 62 of the latching mechanism 38 so that the rounded end 74 of the detent 70 disengages the second concave indentation 94, allowing the retractable portion 12 to move to its fully extended position 18. In its fully extended position 18, the rounded end 74 of the detent 70 enters the third concave indentation 96 which holds the retractable portion 12 in this position 18 until a pushing force in the opposite direction from that applied by Arrow B, as shown by Arrow C, is applied to the button knob 52. The pointed arms 22A and 22B can be used as a tool for repairing a divot when the retractable portion 12 is in its fully extended position 18.

When a reverse pushing force Arrow C is applied to the button knob 52, the detent 70 again moves upward within the hollow interior compartment 62 of the latching mechanism 38 so that the rounded end 74 of the detent 70 disengages the third concave indentation 96, allowing the retractable portion 12 to move to its partially extended position 16. In its partially extended position 16, the rounded end 74 of the detent 70 enters the second concave indentation 94 which holds the retractable portion 12 in this position 16 until a further reverse pushing force Arrow C is applied to the button knob 52.

When a further reverse pushing force Arrow C is applied to the button knob 52, the detent 70 again moves upward within the hollow interior compartment 62 of the latching mechanism 38 so that the rounded end 74 of the detent 70 disengages the second concave indentation 94, allowing the retractable portion 12 to move to its fully retracted position 18. In its fully retracted position 18, the rounded end 74 of the detent 70 enters the first concave indentation 92 which holds the retractable portion 12 in this position 18 until a pushing force Arrow B is again applied to the button knob 52.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A golf divot repair tool comprising:

a retractable portion having two spaced apart pointed arms, said arms spaced apart a proper distance so that the arms serve as a divot repair tool and serve as a tool to engage soft spikes in the sole of a golf shoe, said retractable portion retractable into a case, said retractable portion being releasably lockable by means of a releasable latching mechanism in three alternate locked positions relative to the case, said releasable latching mechanism provided with a retractable detent, said retractable detent provided with a rounded end that is normally biased away from an upper plate of the case, said upper plate removably secured to a lower plate so that the retractable portion is movably receiving between the two plates.

2. A golf divot repair tool according to claim 1 wherein said three alternately locked positions are a fully extended position where the pointed arms extend completely beyond the case so that the pointed arms can be used to repair divots, a partially extended position where the pointed arms extend only partly out of the case so that the pointed arms can be used to engage a soft spike of a golf shoe, and a fully retracted position where the pointed arms do not extend out of the case when the pointed arms are not in use.

3. A golf divot repair tool according to claim 1 further comprising:

a knob attached to said latching mechanism and extending beyond the case so that the knob can be employed to change the position of the retractable portion relative to the case.

4. A golf divot repair tool comprising:

a retractable portion having two spaced apart pointed arms, said arms spaced apart a proper distance so that the arms serve as a divot repair tool and serve as a tool to engage soft spikes in the sole of a golf shoe, said retractable portion retractable into a case, said retractable portion being releasably lockable by means of a releasable latching mechanism in three alternate locked positions relative to the case, a retractable detent provided attached to said knob, said retractable detent provided with a rounded end that is normally biased away from the knob, said rounded end of the detent alternately engagable with three concave indentions provided in the case as a means of releasably locking said retractable portion in one the three alternate locked positions.

* * * * *